US008192261B2

(12) United States Patent
Yang

(10) Patent No.: US 8,192,261 B2
(45) Date of Patent: Jun. 5, 2012

(54) FOOTBALL GAME MACHINE

(76) Inventor: Yi-Chiang Yang, Changhwa (TW)

( * ) Notice: Subject to any disclaimer, the term of this patent is extended or adjusted under 35 U.S.C. 154(b) by 566 days.

(21) Appl. No.: 12/455,497

(22) Filed: Jun. 2, 2009

(65) Prior Publication Data

US 2010/0304809 A1 Dec. 2, 2010

(51) Int. Cl.
*A01H 5/00* (2006.01)

(52) U.S. Cl. ..... 463/3; 463/7; 463/32; 273/401

(58) Field of Classification Search ..... None
See application file for complete search history.

(56) References Cited

U.S. PATENT DOCUMENTS 5,393,049 A * 2/1995 Nelson ..... 473/433
5,957,781 A * 9/1999 Kelly ..... 473/140
6,149,152 A * 11/2000 Mancke ..... 273/123 R
6,224,503 B1 * 5/2001 Joseph ..... 473/422
7,011,310 B2 * 3/2006 Rowan ..... 273/398
2004/0038759 A1 * 2/2004 Kuzia et al. ..... 473/478
2005/0134001 A1 * 6/2005 Rowan ..... 273/401

* cited by examiner

*Primary Examiner* — David E Graybill
(74) *Attorney, Agent, or Firm* — Charles E. Baxley

(57) ABSTRACT

A football game machine includes a goal device divided into multiple strike areas that respectively indicates different score marks. Each strike area has multiple pressure sensor mounted therein. Two casing mounted to two opposite sides of the goal device. Each casing has an inner side having a series of photoelectric cells mounted thereon. The football game machine can calculate the speed of the flying ball by using the time difference of the photoelectric cells and the pressure sensor. A display device is mounted on the goal device for displaying the total scores and the speed of the flying ball. A ball recycle device is mounted in one of the two casings. A football is connected to the ball recycle device via a rope. The ball recycle device can recycle the ball when the game is finished and release the rope before playing the ball.

16 Claims, 6 Drawing Sheets

FOOTBALL GAME MACHINE

BACKGROUND OF THE INVENTION

1. Field of the Invention

The present invention relates to a game machine, and more particularly to a football game machine that has multiple play method and the user can really kick the foot ball.

2. Description of Related Art

The football game has been a popular game for a few hundred years. However, mot of people can not enjoy the game on a ground where football game is played. For offsetting the pity, some football game play tables are marketed for the people who can not enjoy the football game on the ground. The conventional football game play table includes figures that are strung by multiple shafts that respectively pivotally and movably extend through the play table. Consequently, the figures are rotatably to simulate a football player and kick a ball into the goal of the other team. The conventional football game play table has a simple structure and easily to be played such that the conventional football game play table is popular with adults and children.

However, the conventional football game play tables are operated by user's hands such that the basic spirit of football is lost and the simple structure of the conventional football game play tables can not provide changeable and complicated play methods. Consequently, the conventional football game play tables need to be advantageously altered.

The present invention has arisen to mitigate and/or obviate the disadvantages of the conventional football game play tables.

SUMMARY OF THE INVENTION

The main objective of the present invention is to provide an improved football game machine that has multiple play method and the user can really kick the foot ball.

To achieve the objective, the football game machine in accordance with the present invention comprises a goal device including a frame that is divided into multiple strike areas. The strike areas are arranged to a matrix. Each strike area has a numeral module mounted therein for showing the score when the corresponding strike area is stricken. Multiple pressure sensors are mounted on the frame for surrounding the numeral module and sensing the instantaneous pressure when the strike area is stricken. A strike plate is mounted to the frame for closing the strike area and protecting the numeral module. The strike plate is flexible such that the pressure sensors are actuated when the strike plate is stricken and deformed. A first casing and a second casing are respectively mounted to two opposite sides of the goal device. The first casing and the second casing respectively have a series of photoelectric cells mounted thereon. The series of photoelectric cells on the first casing aligns with that on the second casing. An opening is defined in an inner side of the first casing. A display device is mounted on a top of the goal device. The display device has a window disposed thereon for displaying a total score. A ball recycle device is mounted in the first casing and corresponding to the opening in the first casing. A ball connected to the ball recycle device via a rope. The ball has a diameter greater than that of the opening in the first casing. The ball recycle device recycles the rope for positioning the ball when the game is ended and releasing the rope when starting the game.

Further benefits and advantages of the present invention will become apparent after a careful reading of the detailed description with appropriate reference to the accompanying drawings.

DETAILED DESCRIPTION OF THE INVENTION

Figure 1:
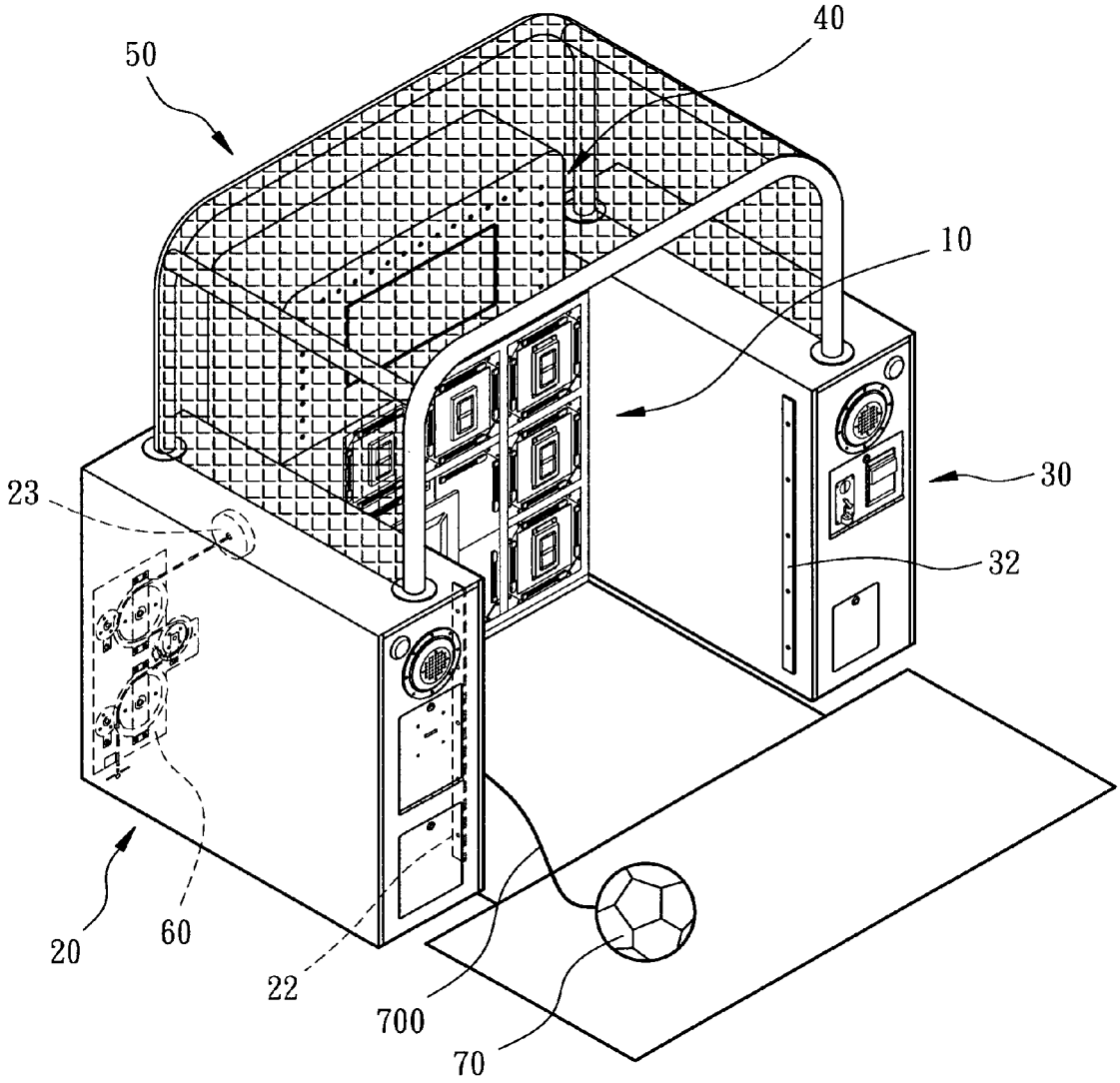
FIG. 1 is a perspective view of a football game machine in accordance with the present invention.

Referring to the drawings and initially to FIGS. 1-4, a football game machine in accordance with the present invention comprises a goal device (10), a first casing (20) and a second casing (30) respectively mounted to two opposite sides of the goal device (10). A display device (40) mounted on a top of the goal device (10). A net is mounted above the two casing (20/30) and covering the display device (40). A ball recycle device (60) is mounted in the first casing (20). A ball (70) is connected to the ball recycle device (60) via a rope (700) and a free end of the rope (700) has a sensing plate (701) mounted thereon.

The goal device (10) has a frame (11) divided into multiple strike areas (12) that are arranged to a phalanx or a matrix. Each strike area (12) has a numeral module (13) mounted therein for showing the score when the corresponded strike area (12) is stricken. Multiple pressure sensors (14) are mounted on the frame (11) for surrounding the numeral module (13) for sensing the instantaneous pressure when the strike area (12) is stricken. A strike plate (15) is mounted to the frame (11) for closing the strike area (12) and protecting the numeral module (13). The strike plate (15) is flexible such that the pressure sensors (14) are actuated when the strike plate (15) is stricken and deformed. In the preferred embodiment of the present invention, the strike plate (15) is made of acrylic.

Each of the first casing (20) and the second casing (30) has a speaker (21/31) mounted thereon for providing sound effects. The first casing (20) and the second casing (30) respectively have a series of photoelectric cells (22/32) mounted thereon. The series of photoelectric cells (22) on the first casing (20) aligns with that on the second casing (30) for sensing the timing of the passing ball (70). The football game machine calculates the fly speed of the ball (70) by using the time different of the photoelectric cells (22/32) and the pressure sensors (14).

The display device (40) has a window (41) disposed thereon for displaying the total score and the speed of the ball (70).

The net (50) is provided to protect the public, who surround the football game machine, from being hit by the kicked ball (70).

The ball recycle device (60) is mounted in a corresponding one of the two casings (20/30). In the preferred embodiment of the present invention, the ball recycle device (60) is mounted in the first casing (20) such that the first casing (20) has an opening (23) defined in an inner side thereof and corresponding to the ball recycle device (60) that includes a dust-proof cover (61) mounted in the opening (23) for holding the ball (70) when being recycled and preventing the dust from entering the first casing (20) when operating the football game machine. The rope (700) extends through the dust-proof cover (61) and is wound upon the ball recycle device (60). The diameter of the opening (23) is smaller than that of the ball (70).

The ball recycle device (60) has a first drive wheel (62) and a second drive wheel (63) mounted thereon and synchronously operated. A first idle wheel (64) is mounted between the first drive wheel (62) and the second drive wheel (63), and laterally corresponding to a line of centers of the first drive wheel (62) and the second drive wheel (63). A limit switch (641) is mounted adjacent to the first idle wheel (64) and the line of centers of the first drive wheel (62) and the second drive wheel (63). The rope (700) is sequentially wound the first drive wheel (62), the first idle wheel (64) and the second drive wheel (63) for promoting the friction among the wheels (62, 64, 63). The ball recycle device (60) further includes a first sensor (65) and a second sensor (66) respectively mounted thereon for prevent the rope (700) from being overly released or recycled, wherein the first sensor (65) is adjacent to the dust-proof cover (61) and corresponds to the first drive wheel (26), and the second sensor (66) is adjacent to the second drive wheel (63).

Figure 4:
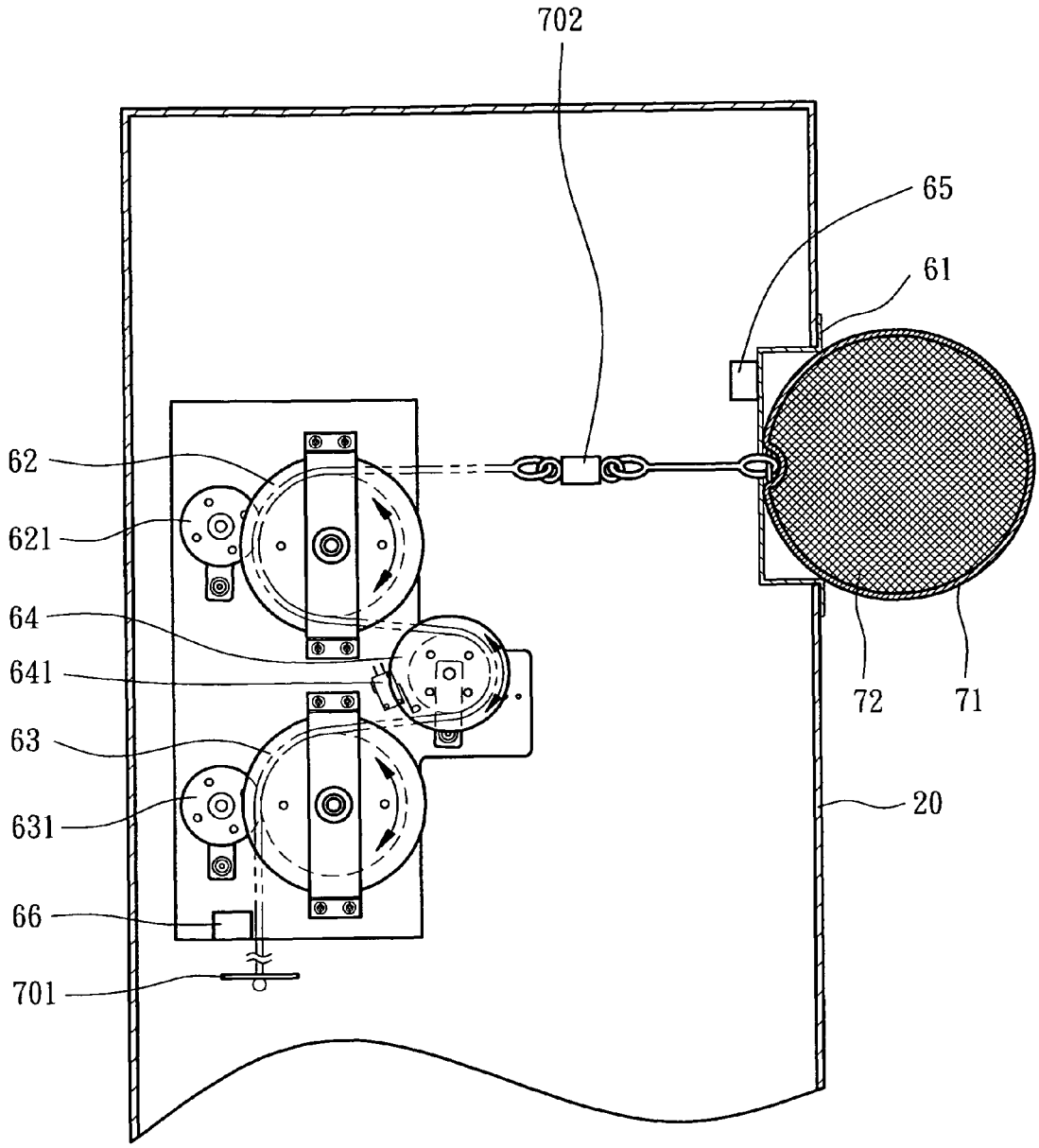
FIG. 4 is a front plan view of a ball recycle device of the football game machine in accordance with the present invention.
Figure 5:
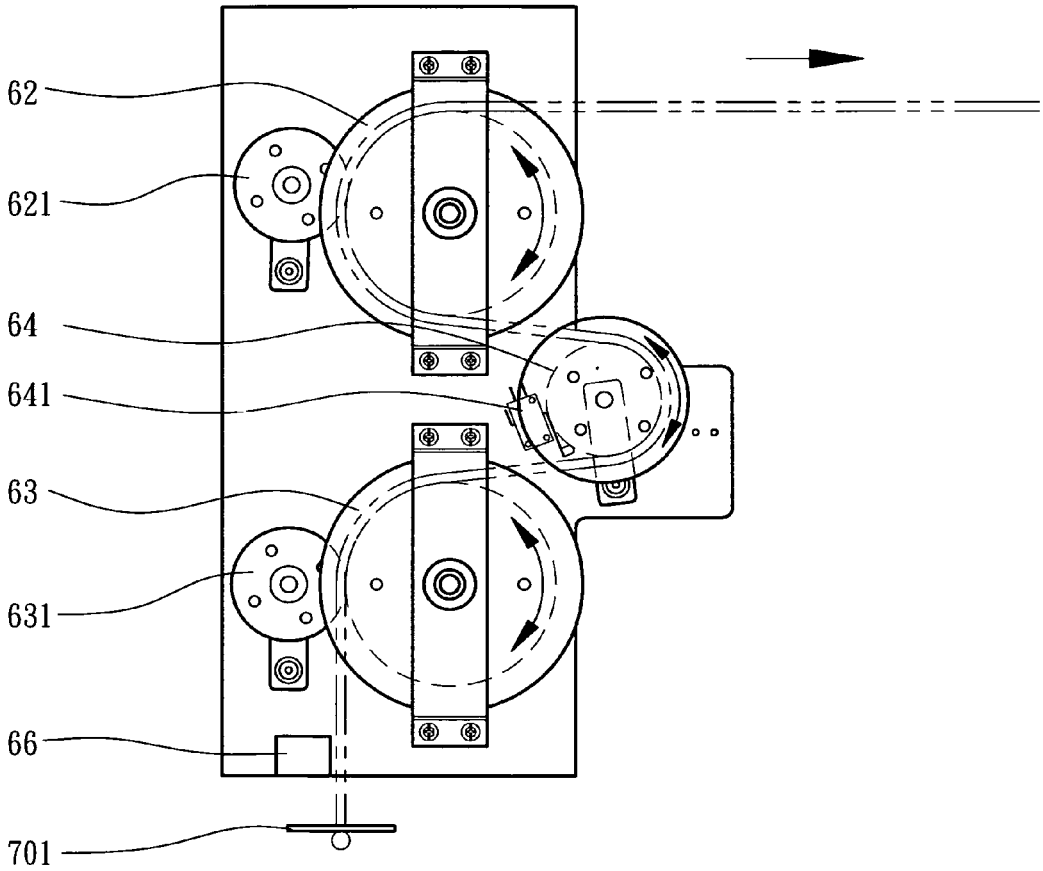
FIG. 5 is an operational view of the ball recycle device in accordance with the present invention.

With reference to FIG. 4, the first drive wheel (62) and the second drive wheel (63) are synchronously clockwise operated, and the first idle wheel (64) is anti-clockwise operated when the ball recycle device (60) releases the rope (700) with the ball (700). The power of the ball recycle device (60) is cut off and finishes the release operation when the second sensor (66) senses the sensing plate (701). The first drive wheel (62) and the second drive wheel (63) are synchronously anti-clockwise operated, and the first idle wheel (64) is clockwise operated when the ball recycle device (60) recycles the rope (700) with the ball (70). The power of the ball recycle device (60) is cut off and finishes the recycle operation when the ball (70) is position in the dust-proof cover (61) and the first sensor (65) senses the ball (70). With reference to FIG. 5, the first idle wheel (64) is moved toward the line of centers of the first drive wheel (26) and the second drive wheel (63) when the rope (700) is pulled and the ball recycle device (60) is operated. The power of the ball recycle device (60) is temporarily cut off for preventing the ball recycle device (60) from an overload condition when the first idle wheel (64) contacts with the limit switch (641). The power of the ball recycle device (60) is restituted and actuated again to finish the operation thereof when the pull force is disappeared and the first idle wheel (64) is separated from the limit switch (641). For enhancing the friction among the rope (700), the first drive wheel (62) and the second drive wheel (63), the ball recycle device (60) further comprises a second idle wheel (621) and a third idle wheel (631) mounted thereon and respectively abutting against the first drive wheel (62) and the second drive wheel (63) such that the rope (700) is clamped between the first drive wheel (62) and the second idle wheel (621), and the second drive wheel (63) and the third idle wheel (631).

With reference to FIG. 4, the ball (70) is kicked again and again. Consequently, a universal connector (702) is mounted on the rope (700) near the ball (70) to prevent the rope (700) from being overly turned around due to the rotating ball (70).

For preventing the ball (70) from being overly sprung after hitting the strike plate (15) and protecting the numeral module (13). The ball (70) of the present invention is different from the conventional ball. The ball (70) has a spherical surface (71) that is made of PVC, and a filler (72) full filled in the spherical surface (71). In the preferred embodiment of the present invention, the filler (72) is soft material, such as cotton fiber and polyethylene foam. Consequently, the filler (72) provides buffer effect when the ball (70) strikes the strike plate (15).

Figure 2:
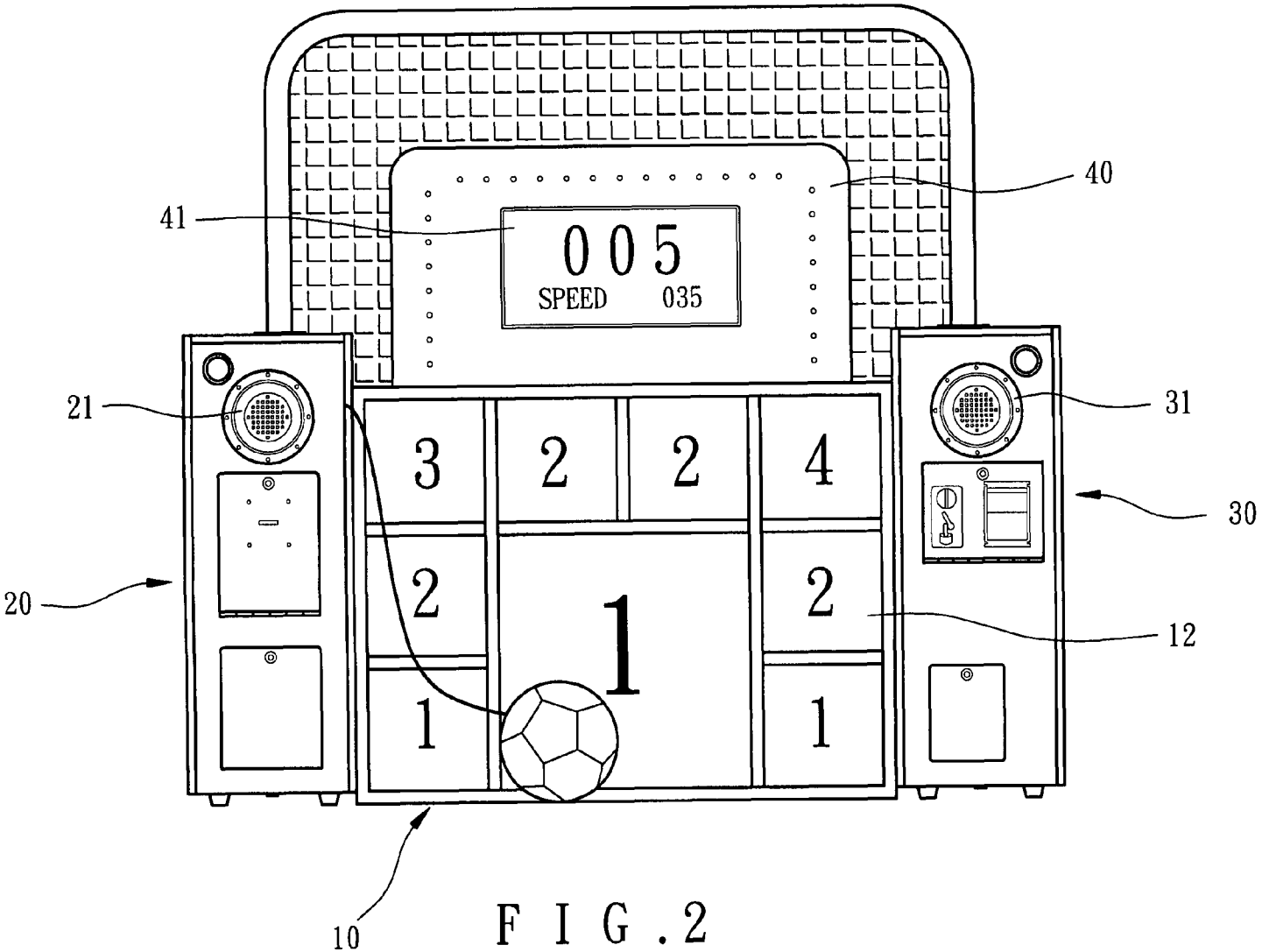
FIG. 2 is a front plan view of the football game machine in FIG. 1.
Figure 3:
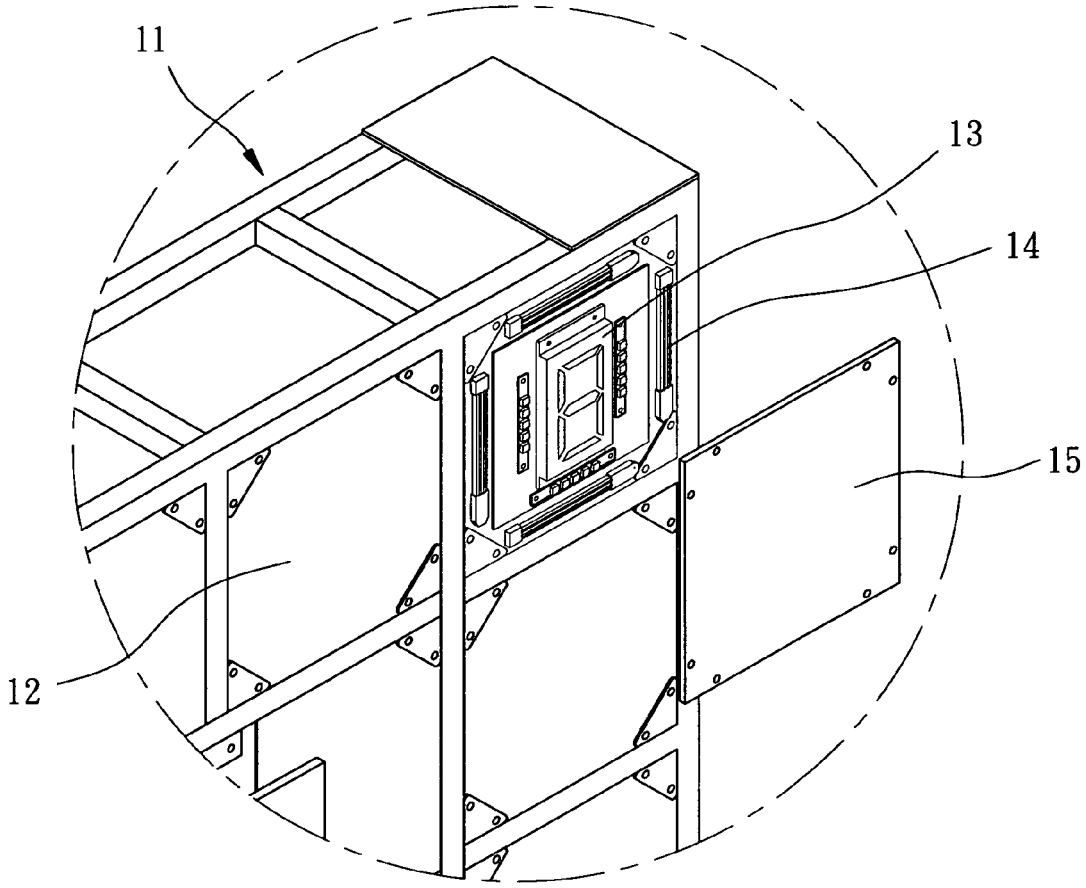
FIG. 3 is a partially exploded perspectives view of the football game machine of the present invention.
Figure 6:
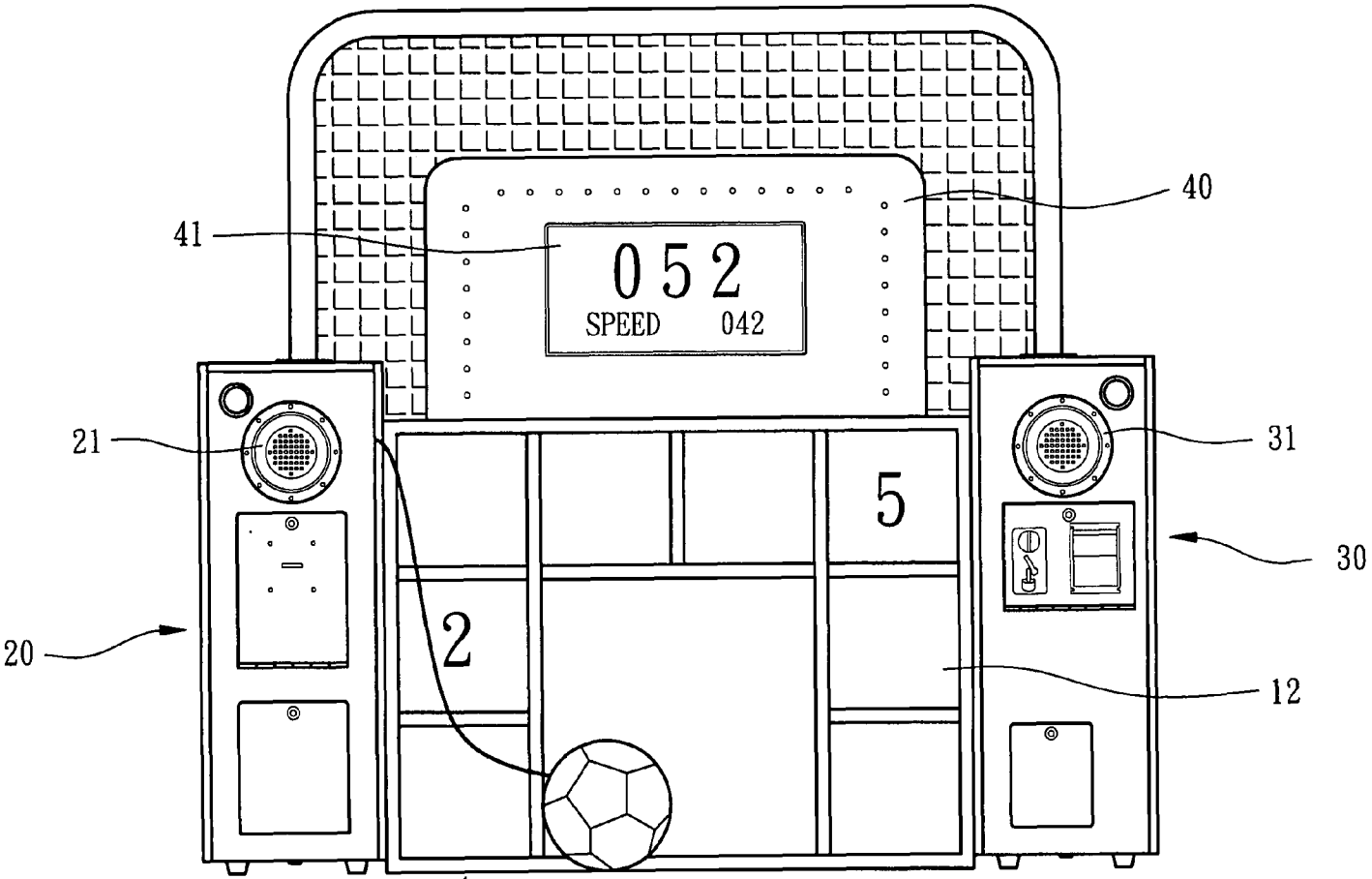
FIG. 6 is a front plan view of the football game machine for showing the different play method.

The playing ways of the football game machine in accordance with the present invention can be arbitrarily installed. With reference to FIGS. 2 and 6, for example, the playing method includes three stages that are preinstall.

First stage: the kick number of times is free and the time is limit. All the numeral modules (13) randomly display a number that is score when striking the corresponding strike plate (15) before entering the game. In addition, the football game machine can calculate the speed of the kicked ball (70) by using the time difference between the photoelectric cells (22/23) and the pressure sensor (14) such that the player can get bonus when the speed of the ball (70) over a preset value. The player can enter the next stage when the total scores over a preset standard.

Second stage: the kick number of times and the preparing time are limited. This mode is provided for training player's control ability and accuracy. Similarly, the player can enter the next stage when the total scores over a preset standard.

Third stage: there are only some numeral modules (13) showing the corresponding score. Namely, the player only adds up his/her scores when striking the strike area (12) in which the numeral module (13) is operated. This mode is provided for training the player to control the route of the flying ball (70).

Although the invention has been explained in relation to its preferred embodiment, it is to be understood that many other possible modifications and variations can be made without departing from the spirit and scope of the invention as hereinafter claimed.

What is claimed is:

1. A football game machine comprising:

a goal device including a frame that is divided into multiple strike areas, the strike areas arranged to a matrix, each strike area having a numeral module mounted therein for showing the score when the corresponding strike area is stricken, multiple pressure sensors mounted on the frame for surrounding the numeral module and sensing the instantaneous pressure when the strike area is stricken, a strike plate mounted to the frame for closing the strike area and protecting the numeral module, the strike plate being flexible such that the pressure sensors are actuated when the strike plate is stricken and deformed;

a first casing and a second casing respectively mounted to two opposite sides of the goal device, the first casing and the second casing respectively having a series of photoelectric cells mounted thereon, the series of photoelectric cells on the first casing aligning with that on the second casing, an opening defined in an inner side of the first casing;

a display device mounted on a top of the goal device, the display device having a window disposed thereon for displaying a total score;

a ball recycle device mounted in the first casing and corresponding to the opening in the first casing; and a ball connected to the ball recycle device via a rope, the ball having a diameter greater than that of the opening in the first casing, the ball recycle device recycling the rope for positioning the ball when the game is ended and releasing the rope when starting the game.

2. The football game machine as claimed in claim 1, wherein a dust-proof cover is mounted in the opening and the rope extends through the dust-proof cover, the ball partially received in the dust-proof cover when being recycled.

3. The football game machine as claimed in claim 1, wherein a universal connector is mounted on the rope near the ball to prevent the rope from being overly turned around due to a rotating ball.

4. The football game machine as claimed in claim 1, wherein the ball has a spherical surface and is full filled of soft material to prevent the ball from being overly sprung after hitting the strike plate, the spherical surface of the ball is made of PVC.

5. The football game machine as claimed in claim 1 further comprising a net mounted above the first casing and the second casing, wherein the net is provided to protect the public, who surround the football game machine, from being hit by the kicked ball.

6. The football game machine as claimed in claim 2, wherein a universal connector is mounted on the rope near the ball to prevent the rope from being overly turned around due to a rotating ball.

7. The football game machine as claimed in claim 2, wherein the ball has a spherical surface and is full filled of soft material to prevent the ball from being overly sprung after hitting the strike plate, the spherical surface of the ball is made of PVC.

8. The football game machine as claimed in claim 2 further comprising a net mounted above the first casing and the second casing, wherein the net is provided to protect the public, who surround the football game machine, from being hit by the kicked ball.

9. The football game machine as claimed in claim 3, wherein the ball has a spherical surface and is full filled of soft material to prevent the ball from being overly sprung after hitting the strike plate, the spherical surface of the ball is made of PVC.

10. The football game machine as claimed in claim 3 further comprising a net mounted above the first casing and the second casing, wherein the net is provided to protect the public, who surround the football game machine, from being hit by the kicked ball.

11. The football game machine as claimed in claim 4, wherein a universal connector is mounted on the rope near the ball to prevent the rope from being overly turned around due to a rotating ball.

12. The football game machine as claimed in claim 5, wherein a universal connector is mounted on the rope near the ball to prevent the rope from being overly turned around due to a rotating ball.

13. A ball recycle device for a football game machine, comprising a first drive wheel and a second drive wheel mounted thereon and synchronously operated, a first idle wheel mounted between the first drive wheel and the second drive wheel, and laterally corresponding to a line of centers of the first drive wheel and the second drive wheel, a rope adapted to be connected to a ball of the football game machine and sequentially wound the first drive wheel, the first idle wheel and the second drive wheel for promoting the friction among the first drive wheel, the first idle wheel and the second drive wheel, a first sensor and a second sensor respectively mounted thereon for prevent the rope from being overly release of recycled, wherein the first sensor corresponding to the first drive wheel and the second sensor adjacent to the second drive wheel, a sensing plate secured on an end of the rope opposite to the football, the first sensor cutting off the power of the ball recycle device when sensing the ball and the second sensor cutting off the power of the ball recycle device when sensing the sensing plate.

14. The ball recycle device as claimed in claim 13 further comprising a limit switch adjacent to the first idle wheel and near a line of centers of the first drive wheel and the second drive wheel, the first idle wheel moved toward the line of centers of the first drive wheel and the second drive wheel when the rope is pulled and the ball recycle device is operated, the power of the ball recycle device temporarily cut off for preventing the ball recycle from an overload condition when the first idle wheel contracts with the limit switch.

15. The ball recycle device as claimed in claim 13 further comprising a second idle wheel and a third idle wheel mounted thereon and respectively abutting against the first drive wheel and the second drive wheel such that the rope is clamped between the first drive wheel and the second idle wheel, and the second drive wheel and the third idle wheel for enhancing the friction among the rope, the first drive wheel and the second drive wheel.

16. The ball recycle device as claimed in claim 14 further comprising a second idle wheel and a third idle wheel mounted thereon and respectively abutting against the first drive wheel and the second drive wheel such that the rope is clamped between the first drive wheel and the second idle wheel, and the second drive wheel and the third idle wheel for enhancing the friction among the rope, the first drive wheel and the second drive wheel.

* * * * *